US006138288A

United States Patent [19]

Archibald

[11] Patent Number: 6,138,288

[45] Date of Patent: Oct. 31, 2000

[54] PORTABLE TOILET SEAT AND COVER LIFTING DEVICE

[76] Inventor: Evers Randolph Archibald, 203 Washington Park, Apt 1, Brooklyn, N.Y. 11205

[21] Appl. No.: 09/404,126

[22] Filed: Sep. 23, 1999

[51] Int. Cl.[7] ..... A47K 13/10

[52] U.S. Cl. ..... 4/246.1

[58] Field of Search ..... 4/246.1–246.5, 4/248–250

[56] References Cited

U.S. PATENT DOCUMENTS

| | | | |
|---|---|---|---|
| 5,177,818 | 1/1993 | Tsai | 4/246.2 |
| 5,280,653 | 1/1994 | Tsai | 4/246.2 |
| 5,289,593 | 3/1994 | Lawrence | 4/246.1 |
| 5,461,733 | 10/1995 | McKee | 4/246.1 |
| 5,713,084 | 2/1998 | Greco | 4/246.1 |
| 5,754,985 | 5/1998 | Dias | 4/246.1 |
| 5,806,106 | 9/1998 | Carter et al. | 4/246.1 |

*Primary Examiner*—Charles R. Eloshway
*Attorney, Agent, or Firm*—Steven Horowitz

[57] ABSTRACT

A device for lifting a cover and/or seat of a toilet bowl includes an inner tube telescoped within an outer tube which is connected to the seat or cover by a hook. The outer tube has a stop element that cooperates with an element on the inner tube to prevent separation. The inner tube is connected to one end of a cable, the other end being connected to a spring. The opposite end of the spring is connected to a handle that is looped over a pulley connected to the toilet tank. When the user pulls down on the handle, the inner tube telescopes inside the outer tube until the stop element is contacted, and continued pulling raises the seat and/or cover.

5 Claims, 4 Drawing Sheets

FIG. 4
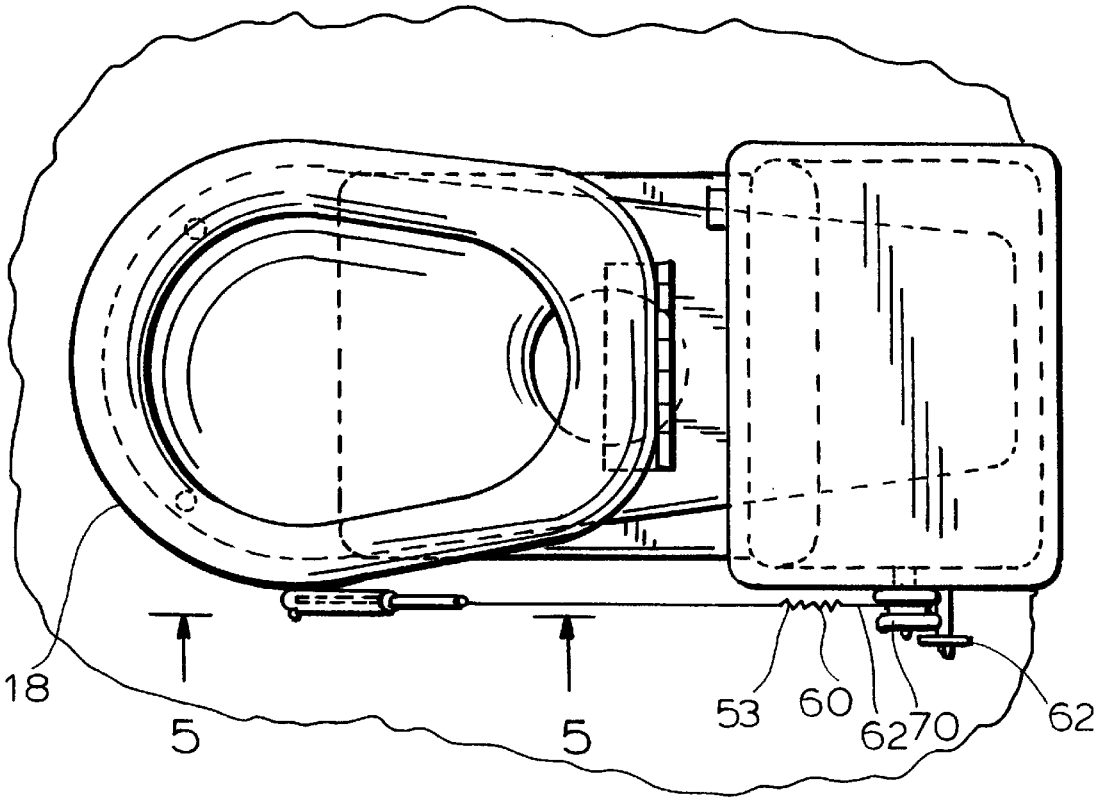
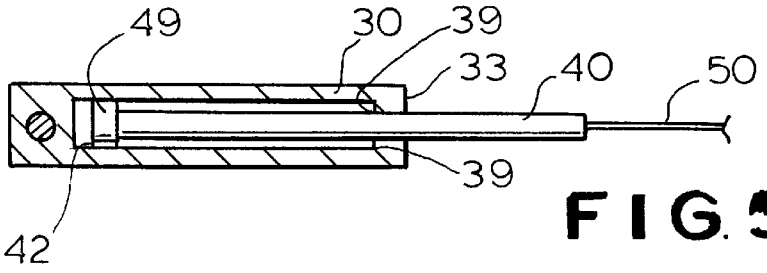
FIG. 5

PORTABLE TOILET SEAT AND COVER LIFTING DEVICE

BACKGROUND OF THE INVENTION

1. Field of the Invention

The present invention relates generally to sanitary devices for toilet seats having covers and in particular it relates to lifting devices for lifting up a toilet seat and the cover of a toilet seat without direct contact with any part of the toilet.

2. Description of the Prior Art

The prior art includes numerous devices for lifting toilet seats without the need for human contact directly with the toilet seat cover. For example, U.S. Pat. Nos. 5,713,084 to Greco, U.S. Pat. No. 5,461,733 to McKee and U.S. Pat. No. 5,806,106 to Carter et al. are toilet seat cover lifting devices. While these devices may be suitable for the particular purposes that they are addressed to, they are not as suitable as the present invention is for lifting the toilet seat and/or seat cover without directly touching the seat, seat cover or any other part of the toilet.

SUMMARY OF THE INVENTION

The present invention is a lifting device for a cover and seat on a bowl of a toilet having a tank and includes substantially cylindrical elongate outer and inner tubes wherein the inner tube telescopes in and out of the outer tube. In the device, the outer tube has a hook at one end, which is also the end of the device, and an elongate flexible cable inside the inner tube extends out of the inner tube toward the toilet tank. In addition, a spring has a first end attached to and extending from a near cable end of the cable to a handle. A separate pulley element of the device can be removably attached to by suction or any other common method from a side of the tank from which it projects outward perpendicularly. The handle wraps around the pulley element when the seat is down. The lifting device is attached to the toilet by securing the hook to a perimeter of an underside of the seat or cover and attaching the pulley element to the tank so that the outer and inner tubes, the cable and the spring are positioned at an incline to the toilet seat. By pulling down on the handle the inner tube is then made to telescope out of the outer tube and then approach the pulley element thereby simultaneously lifting the seat and/or cover to a point near the tank and holding the seat and/or cover in fixed position.

The present invention offers the following important objects and advantages:

(a) it provides a device for lifting a toilet seat and/or toilet seat cover without touching the seat, cover or any other part of the toilet, (b) it provides a device to lift a toilet seat and and/or seat covers of a toilet having a tank by pulling down a handle that pulls a cable connected to an inner tube telescoped in an outer tube that hooks on to the underside of the seat cover, (c) it provides a device for lifting toilet seats and/or seat covers that is very easy to carry, extremely simple to attach, extremely simple to operate, and easy to manufacture, (d) it provides a device for lifting toilet seats and/or covers the operation of which does not involve touching any part of the toilet with one's hands and also involves movements by the user that are not very different from the movements normally engaged in by a user of the toilet, and (e) it provides a toilet seat and a toilet seat cover lifting device that works equally well for the toilet seat as it does for the seat cover of the toilet.

Further objects of the present invention will appear as the description of the invention proceeds.

BRIEF DESCRIPTION OF THE DRAWING FIGURES

FIG. 4 is a top plan view of the toilet seat cover lifting device of the present invention with the seat down.

FIG. 5 is a cross-sectional view of a portion of the device of the present invention taken along line 5—5 of FIG. 4.

DETAILED DESCRIPTION OF THE PREFERRED EMBODIMENT

Figure 1:
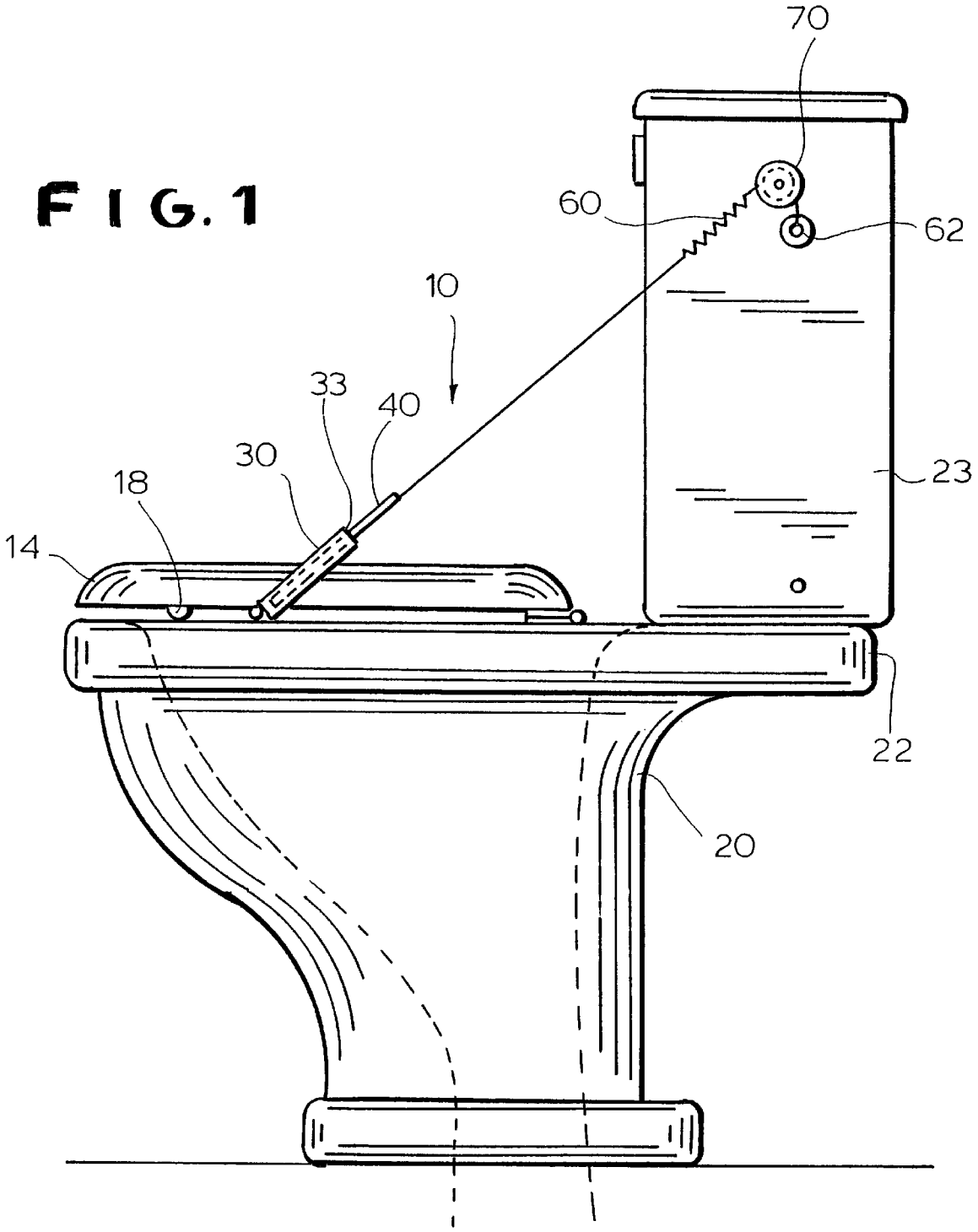
FIG. 1 is a side elevational view of the toilet seat cover lifting device of the present invention with the seat down.
Figure 2:
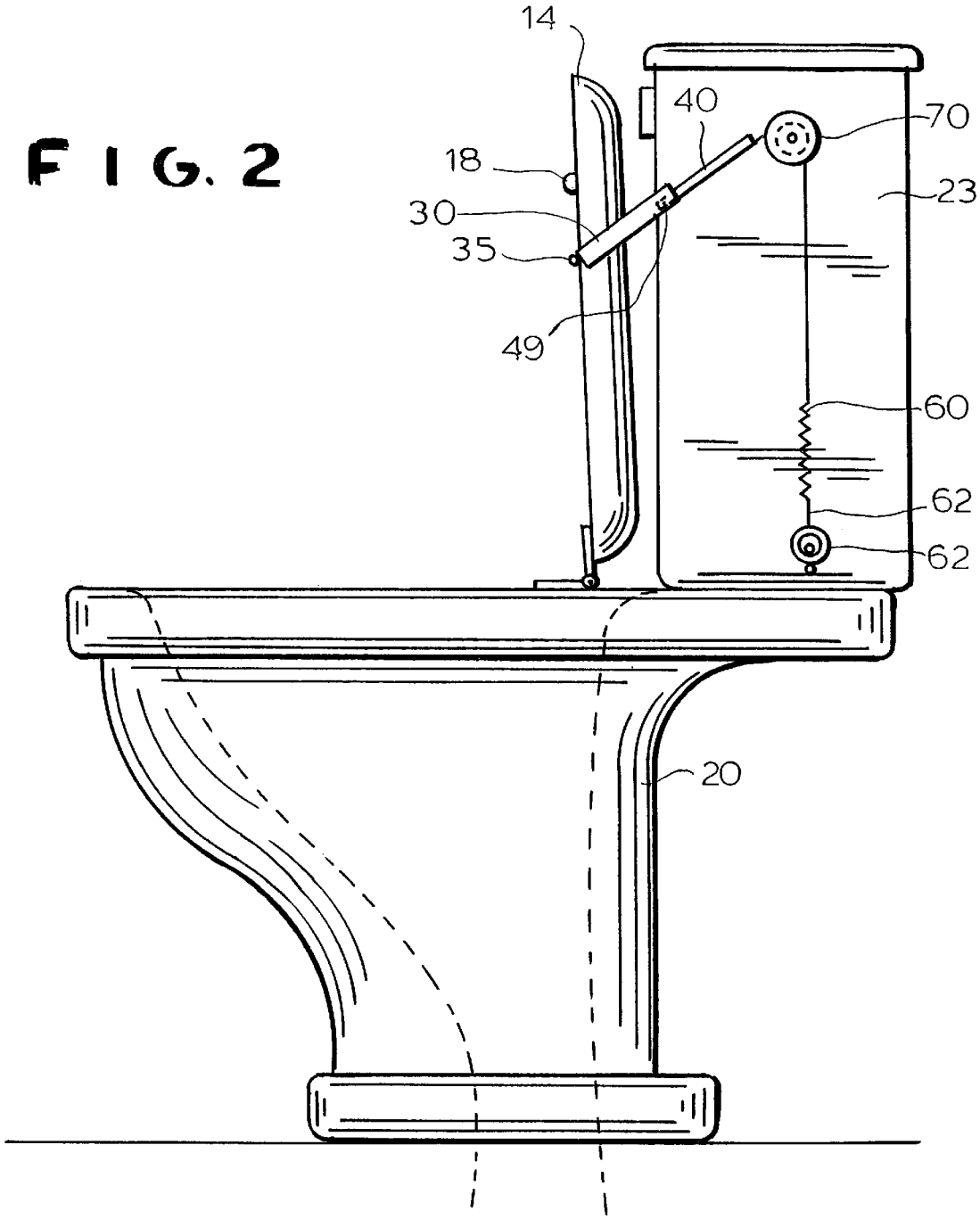
FIG. 2 is a side elevational view of the toilet seat cover lifting device of the present invention with the seat raised.

Turning now descriptively to the drawings, in which similar reference numerals denote similar elements throughout the several views, FIGS. 1 through 5 illustrate a lifting device 10 for a cover 14 and a seat 18 on a bowl 20 of a toilet 22 having a tank 23.

As seen in FIGS. 1–4, lifting device 10 includes a substantially cylindrical hollow elongate outer tube 30 that has a hook 35 at its "hook" end 32. In general, in this patent application, the term "hook end" refers to the end closer to the hook 35 whereas the term "pulley end" refers to an end closer to the pulley element 70 (described further below). The outer tube 30 is open on its pulley end 33. A substantially cylindrical elongate inner tube 40 connected to the outer tube 30 telescopes into the outer tube 30 and can be extended out of the outer tube 30 which is in a direction away from seat 18 when the device is attached since device 10 when attached is on an incline to the seat 18.

Inner and outer tubes 40, 30 are preferably made of plastic.

As seen in FIG. 5, inner and outer tubes 40, 30 have well known stop elements 39, 49 which prevent the inner tube 40 and the outer tube 30 from separating completely from one another. The stop elements 39, 49 may be annular rings or smaller pieces for example a first annular ring 39 on the pulley end 33 of the outer tube. First annular ring 39 has a smaller diameter than an inside diameter of the outer tube 30 and a second annular ring 49 at a far end 42 of the inner tube 40 having a diameter larger than an inside diameter of the first annular ring 39 but smaller, ideally slightly smaller, than the inside diameter of the outer tube 40. This arrangement leaves a space between the inner and outer tubes 40, 30 but no space between the inner tube 40 and the first annular ring 39 such that inner tube 40 snugly telescopes in and out of outer tube 30 by traversing first annular ring 39.

It should be understood that although the particular stopping means, namely annular rings 39, 49, has been described above, the present invention contemplates any other stopping means suitable for an inner tube that telescopes into an outer tube to prevent the inner tube 40 and the outer tube 30 from separating completely from one another. Such stopping means need not include annular rings but may, for example, be any well known stopping means such as a stopper that surrounds only a portion of the circumference of the inner and outer tubes. Th e particular stopping means is not essential to the present invention.

As seen in FIGS. 1–4, lifting device 10 includes elongate flexible cable 50 located inside inner tube 40 that extends out of the inner tube 40 toward the toilet tank 23. Cable 50 is preferably made of flexible rubber so that it is strong but very flexible and cable 50 includes far cable end 52, closer to hook end 32 of outer tube 30, and near cable end 53, closer to pulley element 70 of device 10. Near cable end 53 is located outside of inner tube 40. Typically, and most simply, cable 50 can be fastened to inner tube 40 at an inside portion of inner tube 40 at far end 42 of inner tube 40 proximate hook 35 but this is not critical. Cable 50 need only be securely fastened to inner tube 40. Furthermore, inner tube 40 need not be totally hollow as long as it is sufficiently hollow to allow cable 50 to attach somewhere inside of it. Theoretically, cable 50 can even attach to the outside of inner tube 40.

Device 10 also includes a spring 60 having a first end 62 that is attached to and extends from near cable end 53 of cable 50 to handle 62. Spring 60 is a conventional spring typically made of thin metallic material or hard plastic.

Pulley element 70 is removably attached to and projecting perpendicularly from a side of the tank 23. Typically, pulley element attaches to the tank 23 easily because a first side of pulley element 70 has a cupped suction element 70*a* that allows pulley element 70 to removably attach to the tank 23. Alternatively, pulley element 70 attaches to tank 23 by other known methods of attachment so long as it is removable and preferably easy to attach. The second opposite side of pulley element 70 has a grooved knob 70*b* over which flexible cable 50 rolls when handle 62 is pulled down.

Figure 3:
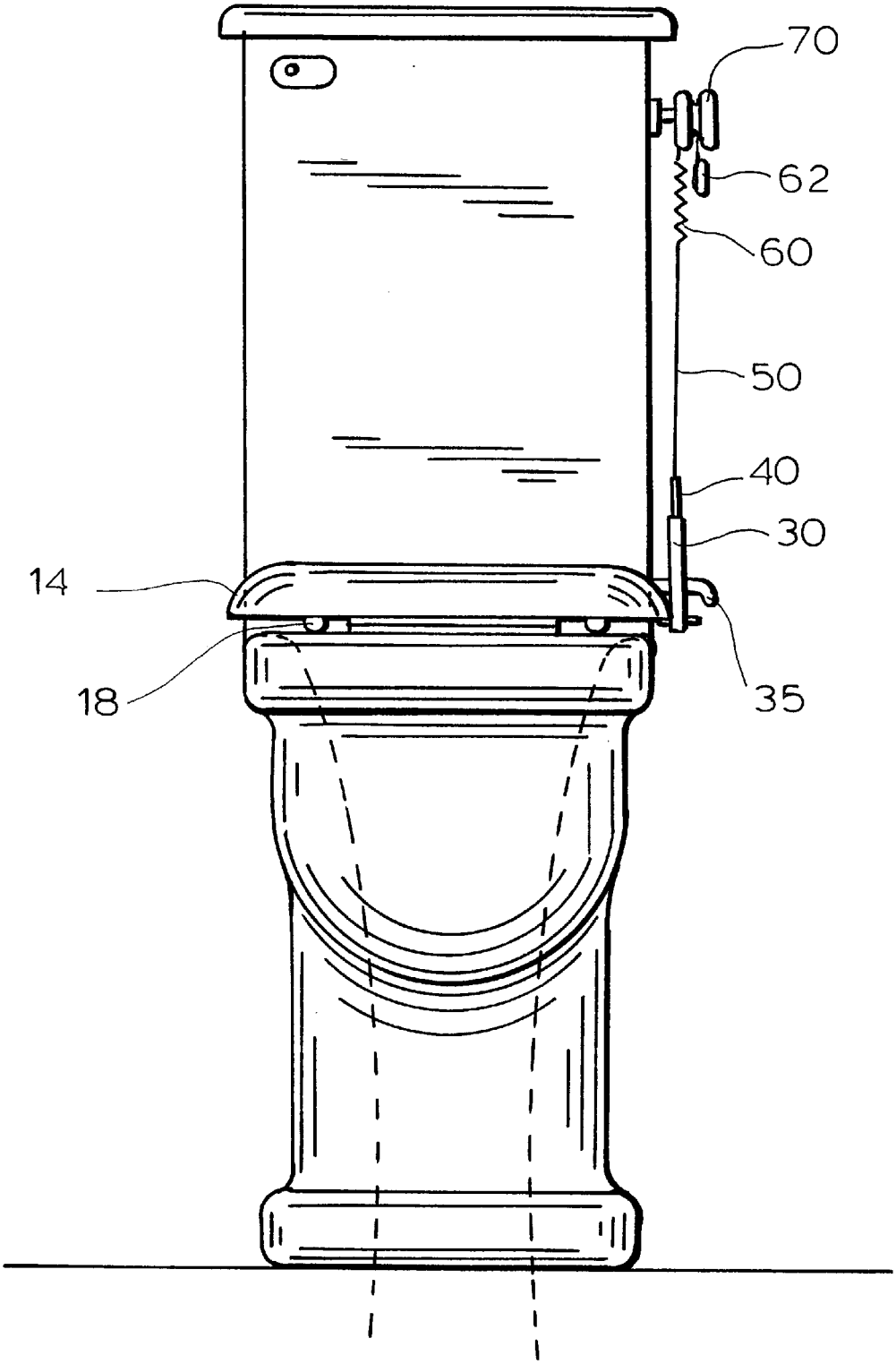
FIG. 3 is a front elevational view of the toilet seat cover lifting device of the present invention with the seat down.

As best seen in FIGS. 1 and 3, prior to operation of the device to lift seat 18 and/or cover 14, handle 62 wraps partially around pulley element 70 in order to lock the lifting device 10 when handle 62 is in an up position, that is, when the toilet seat 18 and/or cover 14 is/are down. When handle 62 is pulled down, cable 50 and spring 60 roll over pulley element 70 like a cord wrapping around a pulley.

Handle 62 and pullet 70 made be made of any suitable material. Ideally, handle 62 and pulley element 70 would be made of a material that can be molded easily, typically plastic.

Lifting device 10 is attached to the toilet by securing hook 3 5 to a perimeter of an underside 18*a* of the seat 18, or alternatively by securing the hook 35 to a perimeter of the underside 14*a* of the cover 14 of seat 18, and in either case by also attaching pulley element 70 to a side of tank 23 by suction or other known means of attachment so that the outer and inner tubes 30, 40, the cable 50 and the spring 60 are positioned along a collinear axis at an incline to the toilet seat 18 (that is, prior to the seat's being raised), the toilet seat 18 typically being positioned parallel to the floor on which the whole toilet 22 rests prior to it being raised.

In operation, pulling down on the handle 62 causes inner tube 40 to first telescope out of or exit outer tube 30 (up to stop element 39) and then as handle 62 is pushed farther downward inner tube 40 is pulled toward and approaches pulley element 70 thereby simultaneously lifting the seat 18 and/or seat cover 14 to a point near tank 23 and holding the seat 18 and/or seat cover 14 in fixed position near tank 23. In the preferred embodiment of the present invention, the fixed position of the seat 18 or cover 14 positions seat 18 and/or cover 14 at less than a ninety degrees angle to the top of the toilet bowl 20. That is, cable 50 is maintained tautly when the seat 18 and/or cover 14 remains in raised position at slightly less than a ninety degree angle with a top of the toilet bowl 20. Toilet bowl 20 is usually but not necessarily parallel to floor on which the whole toilet 22 rests.

While the materials that the elements of device 10 are made of are not critical to the present invention, it is essential that the manufacturing of the device 10 will be simple and therefore it is preferred that the materials be made mostly of plastic or rubber.

As can be seen from the operation of lifting device 10, the user need only attach the device 10 to the toilet 22 having a tank 23 and he or she can lift the seat 18 and/or cover 14 without touching the seat 18, cover 14 or any other part of the toilet 22. This advantage of device 10 makes device 10 particularly useful in public toilets where many parts of such toilet are touched by thousands of people with unsanitized hands and where germs are easily transferred by thereafter touching these toilets anywhere.

In the present invention the handle 62 is near the flushing element (not shown) of the toilet and the hook 35 need only be inserted under the seat 18 and/or cover 14. Accordingly, the movements needed to attach and to operate device 10 are similar to those need to operate a toilet, namely lifting the toilet seat and flushing the toilet. Accordingly, the user of this device 10 need not bend or move in a manner substantially different from the manner ordinarily used for operating a conventional hand flushing toilet.

The foregoing reveal the essence of the present invention so that others can readily adapt it to various applications without omitting essential features It is to be understood that while the apparatus of this invention have been described and illustrated in detail, the above-described embodiments are simply illustrative of the principles of the invention. It is to be understood also that various other modifications and changes may be devised by those skilled in the art which will embody the principles of the invention and fall within the spirit and scope thereof It is not desired to limit the invention to the exact construction and operation shown and described. The spirit and scope of this invention are limited only by the spirit and scope of the following claims.

What is claimed is:

1. A lifting device for a cover and seat on a bowl of a toilet having a tank, comprising:

a) a substantially cylindrical hollow elongate outer tube having a hook at a hook end of the outer tube, the outer tube being open on a pulley end, b) a substantially cylindrical elongate inner tube connected to the outer tube that telescopes into the outer tube, said inner and outer tubes having stop means to prevent the inner and outer tubes from separating completely, c) an elongate flexible cable attached to the inner tube that extends out of the inner tube toward the toilet tank, d) a spring having a first end that is attached to and extends from a near cable end of the cable to a handle, e) a pulley element removably attachable, to and adapted for projecting perpendicularly from a side of the tank, said handle wrapping partially around the pulley element when the seat and/or cover is in a down position, wherein the lifting device is attachable to the toilet by securing the hook to a perimeter of an underside of the seat and/or cover and attaching the pulley element to the tank so that the outer and inner tubes, the cable and the spring are positioned at an incline to a top of the bowl, and wherein pulling down on the handle causes the inner tube to telescope out of the outer tube and thereafter causes the inner tube to approach the pulley element simultaneously lifting the seat and/or cover to a point near the tank and holding the seat and/or cover in fixed position.

2. The lifting device of claim 1, wherein the stop means includes an annular stop element on the pulley end of the outer tube that has a smaller diameter than an inside diameter of the outer tube and an annular ring at a far end of the inner tube having a diameter larger than an inside diameter of the annular stop element and smaller than the inside diameter of the outer tube.

3. The lifting device of claim 1, wherein the fixed position of the seat and/or cover is at less than a ninety degree angle to a top of the bowl.

4. The lifting device of claim 1, wherein the cable is attached to an inside of the inner tube.

5. The lifting device of claim 1, wherein the stop means includes an annular stop element on the pulley end of the outer tube that has a smaller diameter than an inside diameter of the outer tube and an annular ring at a far end of the inner tube having a diameter larger than an inside diameter of the annular stop element and smaller than the inside diameter of the outer tube, wherein the fixed position of the seat and/or cover is at less than a ninety degree angle to a top of the bowl, and wherein the cable is attached to an inside of the inner tube.

* * * * *